US009666175B2

(12) United States Patent
Khatua

(10) Patent No.: US 9,666,175 B2
(45) Date of Patent: May 30, 2017

(54) NOISE CANCELATION SYSTEM AND TECHNIQUES

(71) Applicant: zPillow, Inc., Sunnyvale, CA (US)

(72) Inventor: Chidananda Khatua, Sunnyvale, CA (US)

(73) Assignee: zPillow, Inc., Sunnyvale, CA (US)

( * ) Notice: Subject to any disclaimer, the term of this patent is extended or adjusted under 35 U.S.C. 154(b) by 0 days.

(21) Appl. No.: 14/789,298

(22) Filed: Jul. 1, 2015

(65) Prior Publication Data

US 2017/0004818 A1 Jan. 5, 2017

(51) Int. Cl.

| | |
|---|---|
| ***G10K 11/16*** | (2006.01) |
| ***H04R 3/00*** | (2006.01) |
| ***G10K 11/178*** | (2006.01) |
| ***H04R 29/00*** | (2006.01) |
| ***H04R 1/02*** | (2006.01) |
| ***G10L 21/0216*** | (2013.01) |
| ***H04R 1/40*** | (2006.01) |

(52) U.S. Cl.

CPC ..... *G10K 11/1786* (2013.01); *G10L 21/0216* (2013.01); *H04R 1/028* (2013.01); *H04R 1/406* (2013.01); *H04R 29/005* (2013.01); *G10K 2210/12* (2013.01); *G10K 2210/3012* (2013.01); *G10K 2210/3215* (2013.01); *G10K 2210/3221* (2013.01); *H04R 2203/12* (2013.01); *H04R 2410/01* (2013.01); *H04R 2410/05* (2013.01); *H04R 2430/20* (2013.01)

(58) Field of Classification Search

CPC ..... G10K 11/178; G10K 11/1784; G10K 11/1786; G10K 2210/12; G10K 2210/3012; G10K 2210/3023; G10K 2210/3045; G10K 2210/3215; G10K 2210/3221; H04R 3/005; H04R 3/00; H04R 1/028; H04R 2410/05; H04R 29/005; G10L 2021/02166; G10L 21/02; G10L 21/0216; G10L 21/0208; G10L 21/0272

See application file for complete search history.

(56) References Cited

U.S. PATENT DOCUMENTS

| | | | | |
|---|---|---|---|---|
| 7,020,288 | B1 * | 3/2006 | Ohashi | G10K 11/178 381/71.4 |
| 2009/0147965 | A1 * | 6/2009 | Kuo | G10K 11/002 381/71.6 |
| 2012/0210741 | A1 * | 8/2012 | Fujiwara | G10K 11/1786 381/71.12 |
| 2013/0204617 | A1 * | 8/2013 | Kuo | H04R 3/002 704/233 |

(Continued)

*Primary Examiner* — Thang Tran

(74) *Attorney, Agent, or Firm* — Wilmer Cutler Pickering Hale and Dorr LLP

(57) ABSTRACT

Techniques for noise cancelation include an automated method having the steps of: receiving signals from a plurality of microphones positioned within a microphone array outside a target area; identifying, from the received signals, a noise and position information for a source for the noise external to the target area before the noise reaches the target area; before the noise reaches the target area, determining a cancelation sound for the noise based on the noise and the position information; and playing the cancelation sound as the noise reaches the target area so as to significantly cancel the noise within the target area.

12 Claims, 7 Drawing Sheets

(56) References Cited

U.S. PATENT DOCUMENTS

| | | | | |
|---|---|---|---|---|
| 2015/0063583 | A1* | 3/2015 | Ni | G10K 11/1786 381/71.6 |
| 2016/0093282 | A1* | 3/2016 | Moshksar | G10K 11/1786 381/71.1 |

* cited by examiner

NOISE CANCELATION SYSTEM AND TECHNIQUES

BACKGROUND

People need a quiet and comfortable sleep environment in order to gain the full benefits of restful sleep. However, real sleep environments often include a variety of noises—for instance snoring and other noises from a sleep partner; machine and ventilation noises from the house; and vehicle and animal noises from outside. An ideal sleep environment would eliminate these potentially disruptive sounds.

Current noise cancellation technologies are fairly limited. Conventional active noise cancellation technology is effective in a very close proximity range when the user is wearing headphones with speakers right next to the ear. For a user to experience silence, they have to wear the noise cancelling headphones, which are often uncomfortable and inconvenient. Other solutions, such as ear plugs or white noise machines, are less than totally effective as they muffle or drown out noises rather than cancelling them.

There is therefore a need for noise cancellation technology that genuinely eliminates noises while not adversely affecting the comfort of the user.

SUMMARY

In accordance with the disclosed subject matter, systems and methods are described for multi-directional noise cancellation. Disclosed subject matter includes, in one aspect, an automated method for noise cancellation, including: receiving signals from a plurality of microphones positioned within a microphone array outside a target area; identifying, from the received signals, a noise and position information for a source for the noise external to the target area before the noise reaches the target area; before the noise reaches the target area, determining a cancelation sound for the noise based on the noise and the position information; and playing the cancelation sound as the noise reaches the target area so as to significantly cancel the noise within the target area.

In other aspects, a beam forming algorithm can be used to identify the position information for a source for the noise. The beam forming algorithm can be selected in order to minimize the time needed to identify the position information such that the total processing time necessary before the cancelation sound is determined, is played, and reaches the target area is less than the time it takes the noise to reach the target area.

In other aspects, determining the cancelation sound can include determining directional components of the cancelation sound to play over speakers selected from a plurality of speakers disposed near the target area for noise cancelation.

In other aspects, determining the cancelation sound can include using a least mean squares algorithm against a plurality of preselected spatial points within the target area in order to minimize the resulting sound at the preselected points.

The automated method can further include the steps of: receiving second signals from a plurality of the microphones; identifying, from the second signals, a second noise and second position information for a source for the second noise within the target area; determining a second cancelation sound for the second noise based on a feedback equation applied to the second noise and second position information; and playing the cancelation sound to minimize the second noise.

In another aspect, disclosed subject matter includes a system for noise cancelation, comprising an array of microphones positioned to detect noises outside a target area; a controller configured to receive data from the microphone array, use beam forming to identify the details of detected noises, and generate cancellation noises; and a plurality of speakers configured to play cancelation noises received from the controller. The array, the controller, and the plurality of speakers are configured such that the total time delay associated with a noise reaching the microphones, the microphones detecting noises outside the target area, the controller receiving and processing the data representing those noises and generating cancellation noises, the cancelation noises being played over the speakers, and the cancellation noises reaching the target area is less than the time for the noise to reach the target area.

In other aspects, the array, the controller, and the speakers can all be disposed in a single portable device. The device can be a pillow in some embodiments. The target area above the surface of the pillow can be where the pillow is shaped and configured to receive a head.

These and other capabilities of embodiments of the disclosed subject matter will be more fully understood after a review of the following figures, detailed description, and claims.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing.

DETAILED DESCRIPTION

The present invention extends known techniques for one-to-one noise selection and, taking into account beam forming and various acoustic principles, provides a system for many-to-many noise cancellation. An array of microphones are positioned surrounding a target area such that they can detect noises originating outside the target area. The microphones send signals to circuitry optimized to be able to calculate and generate noise cancelling signals within the target area before the noise reaches the target area.

Figure 1:
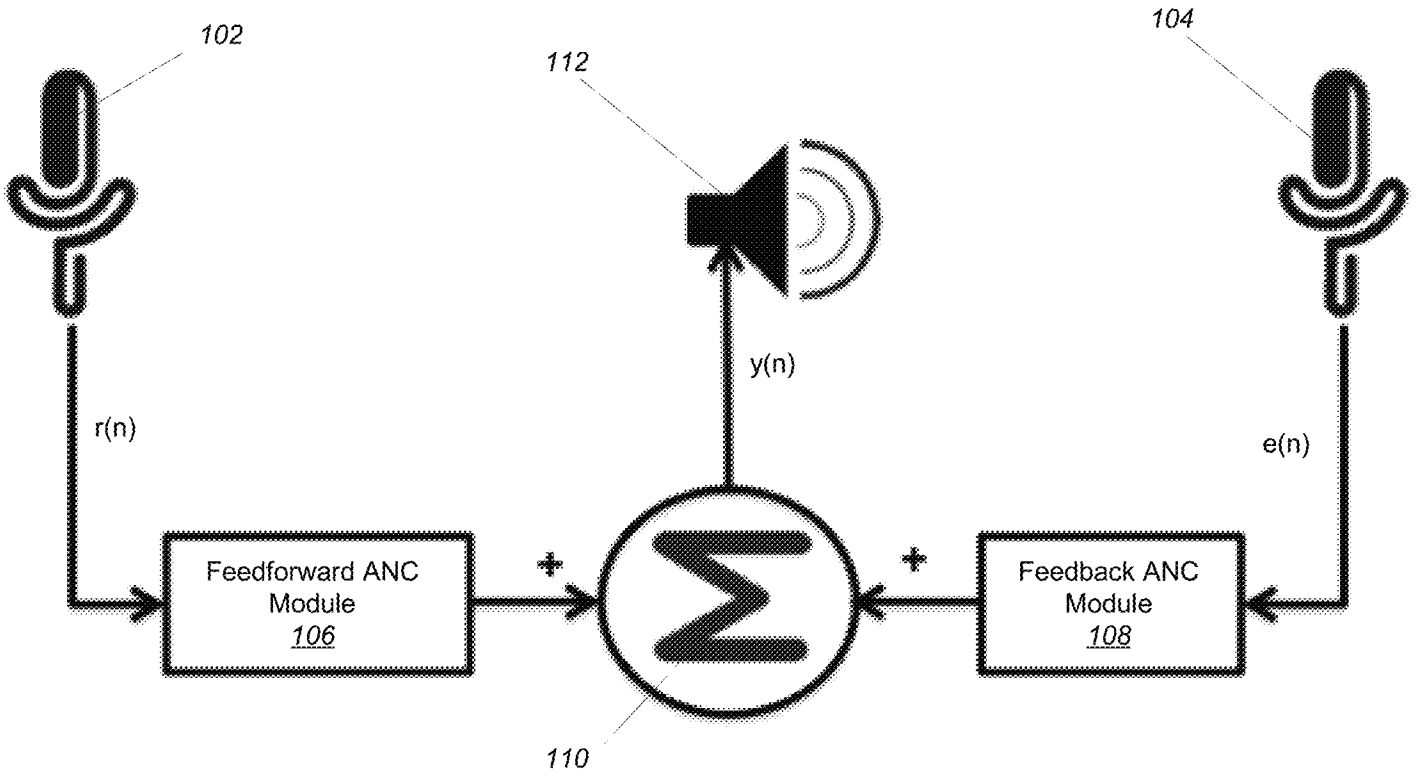
FIG. 1 is a block diagram illustrating noise cancellation as known in the art.

FIG. 1 illustrates a prior art system for single-source noise cancellation, particularly for active noise cancellation. A first microphone 102 produces a reference signal r(n), while a second error microphone 104 produces an error signal e(n). In some implementations, each of the signal feels r(n), e(n) may be fed to a module associated with adaptive noise cancellation formulae: the r(n) feed may be fed to a feed-forward ANC module 106, while the e(n) feed is used as input for a feedback ANC module 108. The input of those modules may be fed to a synthesis module 110 and the output used to generate cancellation signals at one or more speakers 112.

Variations on the FIG. 1 architecture exist, including use of only the reference signal or only the error signal without the other, but these variations share the shortcoming of considering the noise source and noise cancellation area as a single signal without taking into account position and direction.

Figure 2:
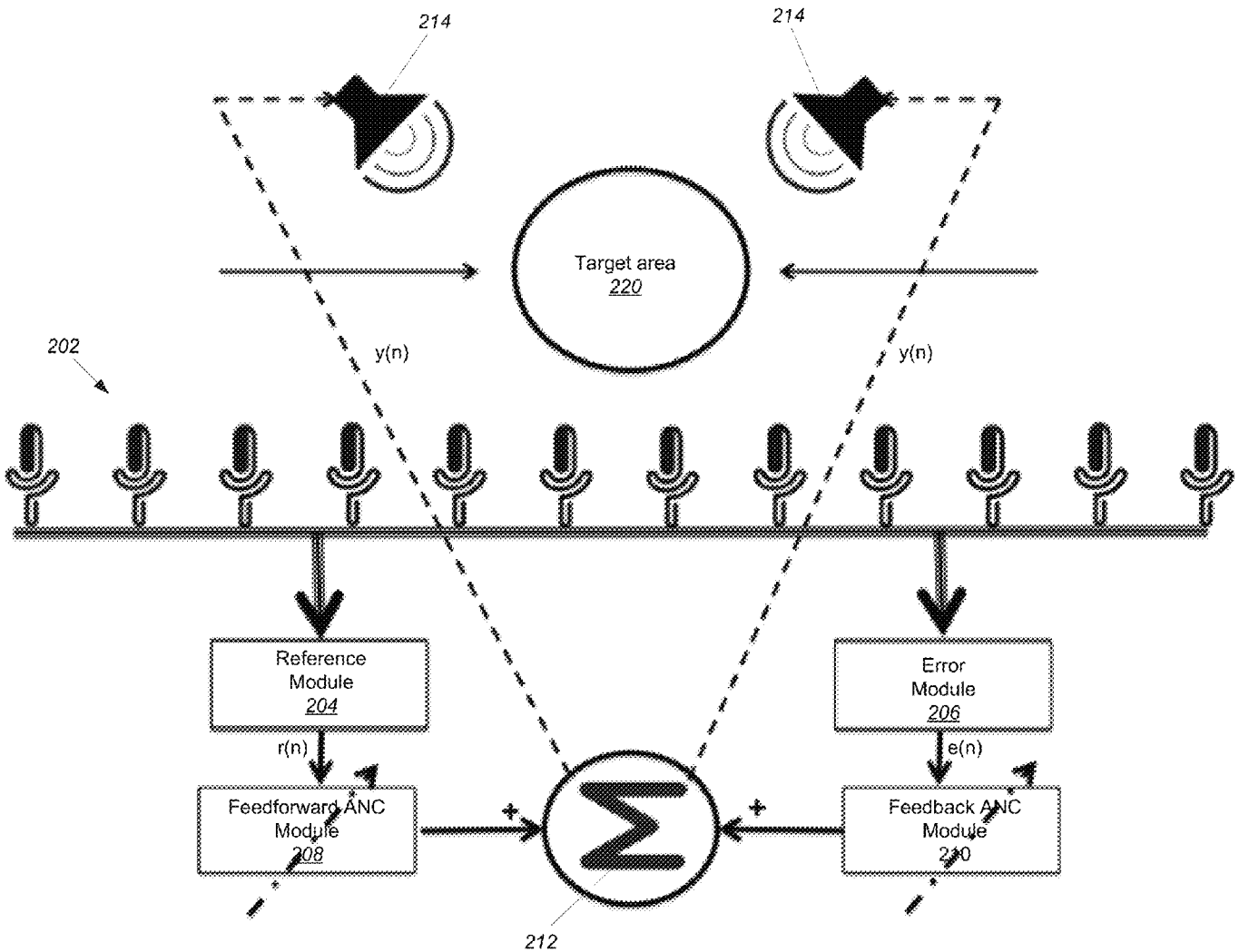
FIG. 2 is a block diagram illustrating a noise cancellation architecture in accordance with embodiments of the present disclosure.
Figure 2A:
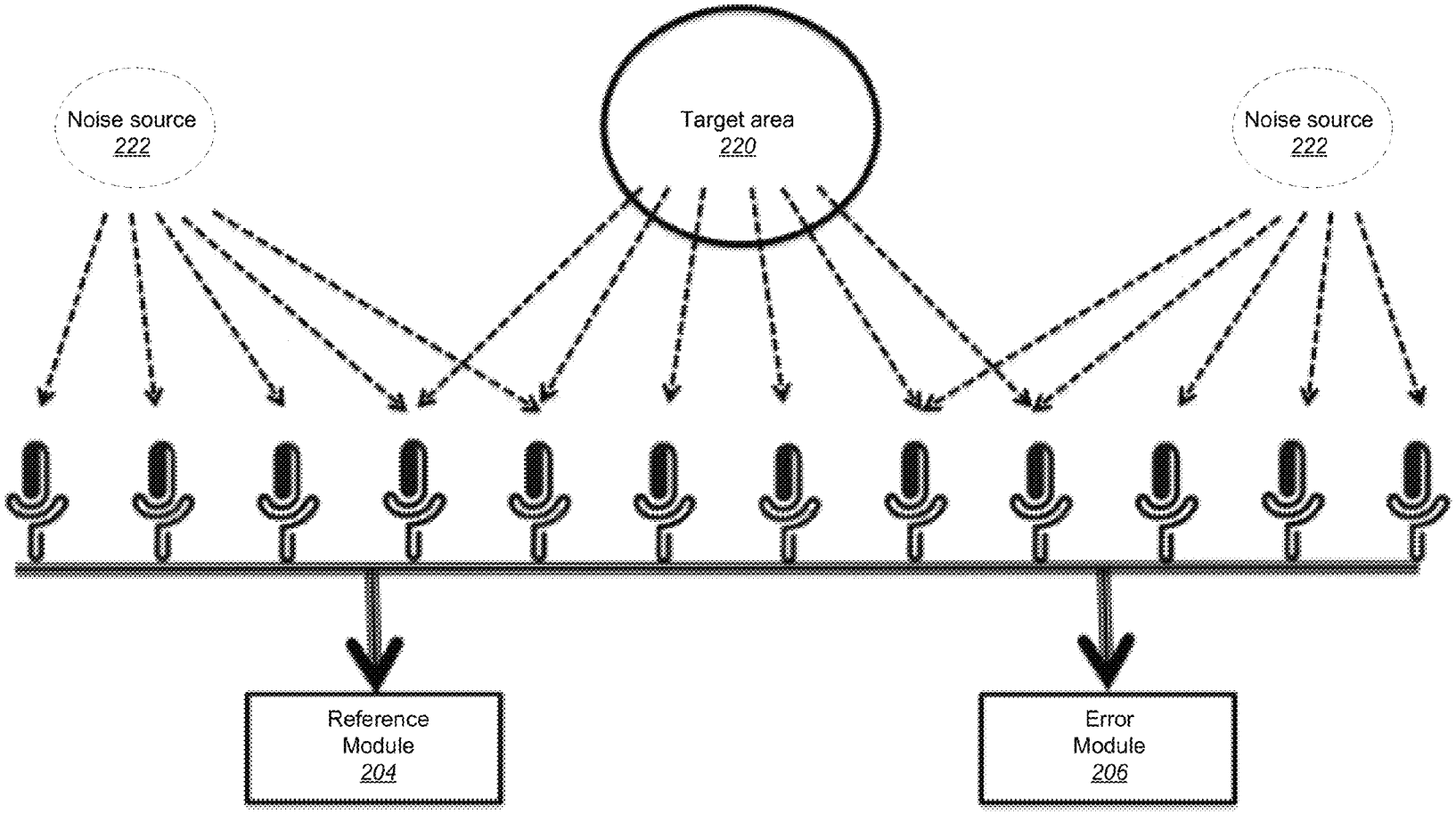
FIG. 2A is a diagram illustrating beam forming with a redundant microphone array in accordance with embodiments of the present disclosure.

FIG. 2 shows an improved architecture for addressing a many-to-many signal situation in noise cancelation. Here, a redundant microphone array 202 is used, in which the microphones are spaced and positioned around a target area 220 to provide meaningful position and direction information. FIG. 2A illustrates how the microphone array 202 receives sounds from both the target area 220 and noise sources 222, and how the same microphone can receive multiple sounds from more than one source.

As illustrated in FIG. 2, the microphone array 202 sends data to each of a reference module 204 and an error module 206. In some implementations, each of the reference module 204 and the error module 206 include beam forming equations, by which the position and direction information derivable by the microphone array can be used to determine the source and direction of one or more sound signals. The reference 204 module isolates sounds that, according to the result of calculating direction vectors with beam forming, originate from outside the target area 220, while the error module 206 isolates sounds that originate from inside the target area 220. The resulting reference data r(n) and error data e(n) may include multiple position and amplitude vectors representing the result of processing the data from the microphone arrays.

The resulting beam formed reference data r(n) is then passed to a feedforward ANC module 208 that, as above, includes parametric optimization to provide cancellation for the reference data. At the same time, the beam formed error data e(n) is passed to a feedback ANC module 210 that, as above, includes parametric optimization to provide cancellation according to the error data. An aggregation module 212 receives the result of both ANC modules 208, 210 and forms a cancellation signal y(n), which again may include directional components. The cancellation signal y(n) is played over a plurality of positioned directional speakers 214, which are positioned relative to the target area 220 so as to properly deliver the directional cancelation signal calculated from the modules 204, 206, 208, 210, and 212.

Figure 3:
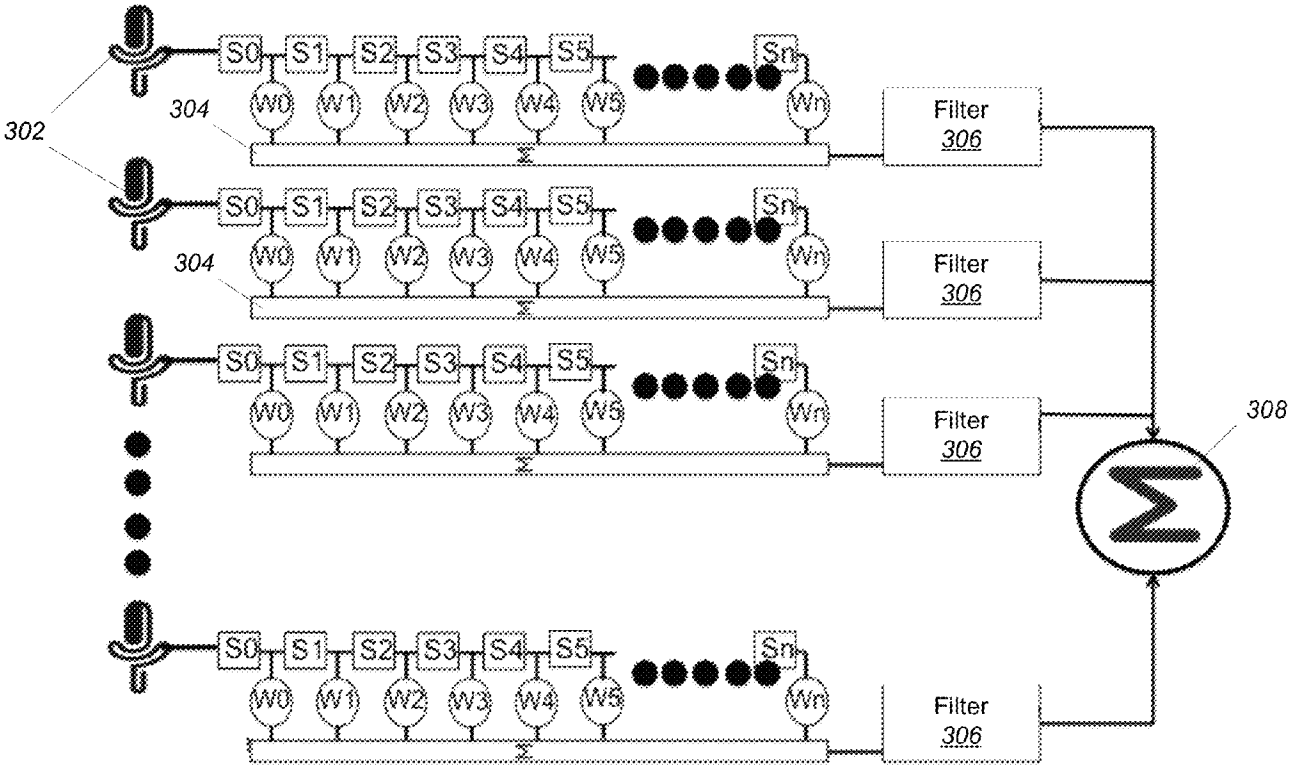
FIG. 3 is a diagram illustrating a beam forming approach for the reference beam forming in accordance with embodiments of the present disclosure.

FIG. 3 is a digital logic diagram illustrating an example of beam forming from the redundant microphone array. For each microphone 302 in the redundant array, the signal is broken into a number of phase components $S_0$, $S_1$, $S_2$ . . . $S_n$ based on standard time- and spatial-dependent techniques such as, for example, Fourier transform. Each component Si for i=1 to n is then weighted according to a corresponding weighting factor $W_i$, which may differ for each component for each microphone, before the weighted averages are summed at an aggregation module 304 for that microphone 302. The weighting factors $W_i$ are determined based on an initial calibration sequence, and maintenance of the system may involve periodic re-calibration (which, in some implementations, may be an automated procedure). The signal may also pass through a filter 306 which may smooth certain features of the signal or eliminate signal components below a threshold frequency as static. A further aggregation module 308 receives each of the converted, processed, and cleaned signals and combines them into data reflecting each of the signals received. As multiple noise sources may be detected at the same time, the system may be capable of isolating, profiling, and beam forming multiple noises at once within the reference data.

Figure 4:
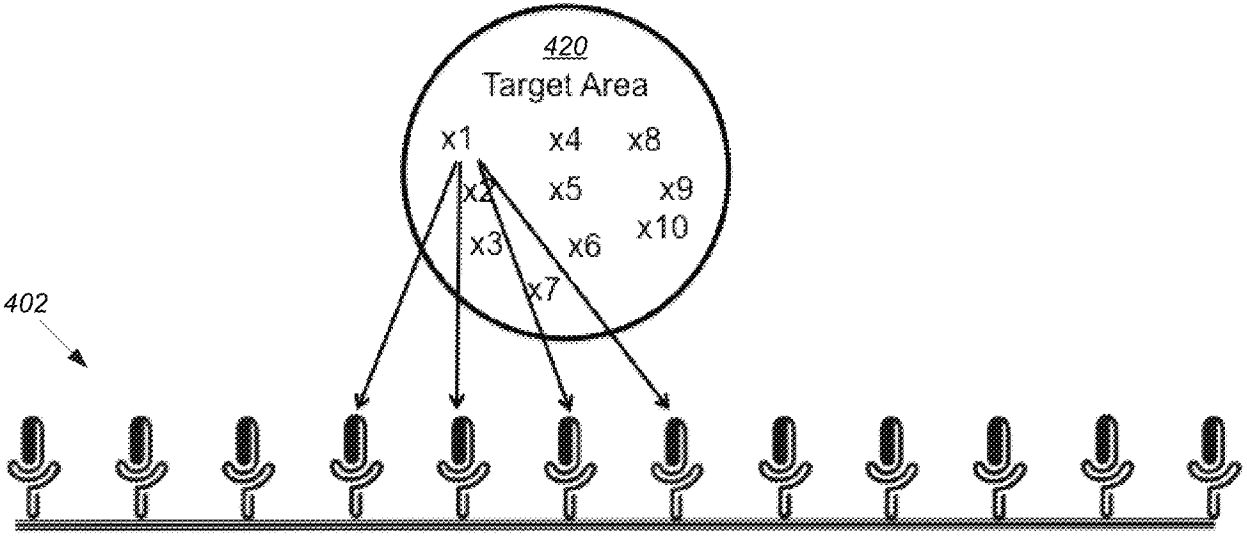
FIG. 4 is a diagram depicting error detection at multiple designated points in accordance with embodiments of the present disclosure.

FIG. 4 shows how, in some implementations of the present invention, particular points in the target area 420 may be selected for noise minimization by means of feedback algorithms as described herein. For example, sound from $x_1$ as shown may be detected by multiple microphones of the microphone array 402, and sound at each of the additional points $x_2$-$x_n$ may be detected by the array 402 as well. In one implementation, the equations may seek a least mean square of all of the signals produced at the points $x_1$-$x_n$, taking those points as error from the "true" (desired) value of zero sound at all points.

One of the requirements for adequate noise cancellation is that the full time delay between receiving noise signals and responding with cancellation sounds must be minimized. The time delay must be taken into account, and a time delay past a certain threshold will not allow for timely response to environmental noise conditions.

The overall timing requirement for the architecture is that it generally satisfy the following:

$$T_{nm}+T_{refB}+T_{SigP}+T_{st}<=T_{nt}$$

Where $T_{nm}$ is the maximum time delay from the noise source to the detecting microphones, $T_{refB}$ is the time from detection by the microphone and conversion to the beam formed reference signal, $T_{SigP}$ is the computational delay in the signal processing modules, $T_{st}$ is the acoustic delay from the speaker to the target area. The total time delay represented by all of these elements collectively must be less than or equal to $T_{nt}$, the time for sound to travel from the noise source to the target, for the system to be able to effectively cancel the noise. Each of these elements is treated briefly below.

In order to minimize $T_{refB}$, beam forming can be conducted using a variety of different algorithms, but in certain implementations of the present disclosure, beam forming may be limited to one of least square, least mean square, matrix inversion, constant modulus, and decision directed algorithms. Certain time-intensive algorithms, such as recursive least square, are excluded from consideration for introducing excessive delay in the process.

In order to minimize $T_{SigP}$, certain algorithms may be selected for certain modules in the calculation of signal response based on the relative speed of those algorithms. Digital signal processing with minimal computational delay are preferred. In some implementations, parallel processing circuitry, such as the use of a systolic array to receive and manipulate data from elements of the microphone array, may help minimize the delay introduced by the digital signal processing. Where the signal processing modules include the use of parametric optimization, in some implementations the parametric values used in the optimization procedures may be imbedded directly into the hardware to avoid the delays associated with fetching and reading variables from memory. Other optimizations to digital signal processing hardware as known in the art can be implemented to meet the overall timing requirements of the system.

Positioning of the system elements is critical for both $T_{nm}$ and $T_{st}$ to be significantly less than $T_{nt}$. The microphone array needs to be configured such that those microphones that detect a particular noise are significantly closer to that noise than the target area. In addition to broadly spacing the microphones to allow for this, the system should also limit its consideration to a select number of microphones that most clearly meet this limitation. In some implementations, therefore, the system will be limited to processing noises that, for a particular subset of microphones, are on the opposite side of the microphones from the target area.

For minimizing $T_{st}$, the speakers should be as close to the target area as practicable while still providing the necessary directionality to accurately cancel detected noises in different directions. In some implementations, the system may select certain speakers over others due to the direction of the noise source and the anticipated delay introduced by each of the speakers.

In some implementations, the system may include a periodic calibration phase in which optimal weightings are applied to different signals for the beam forming and ANC modules. These weighting may be held constant during standard noise cancelation operation of the system in order to reduce latency and satisfy the time delay criteria as described above. However, if error signals e(n) exceed an established threshold, the system can automatically carry out a further calibration step in order to adapt to an environment in which an unacceptable amount of noise is penetrating the target zone.

Figure 5:
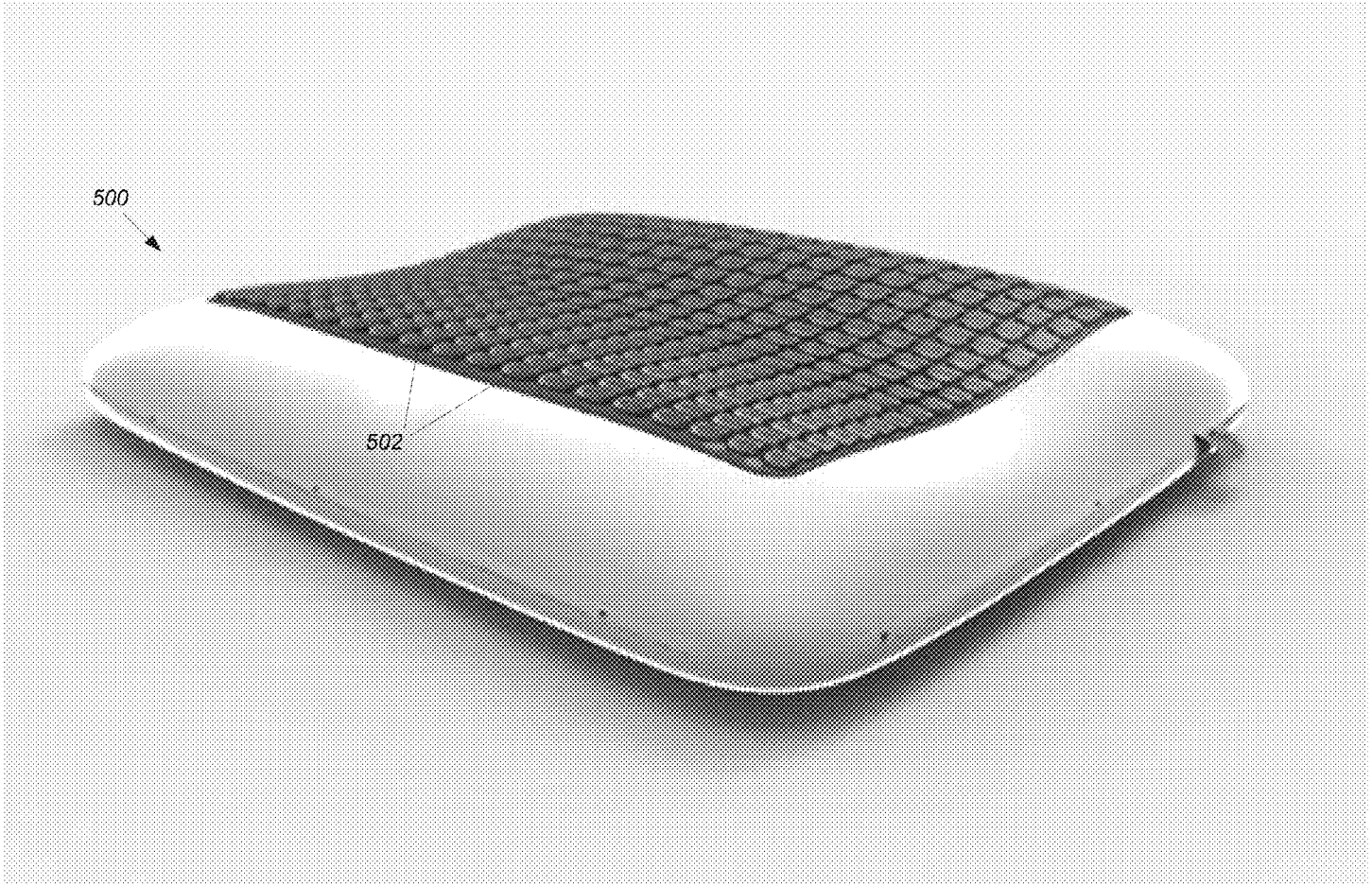
FIG. 5 is pictorial diagram illustrating how the redundant microphone array may be arranged in accordance with embodiments of the present disclosure.
Figure 6:
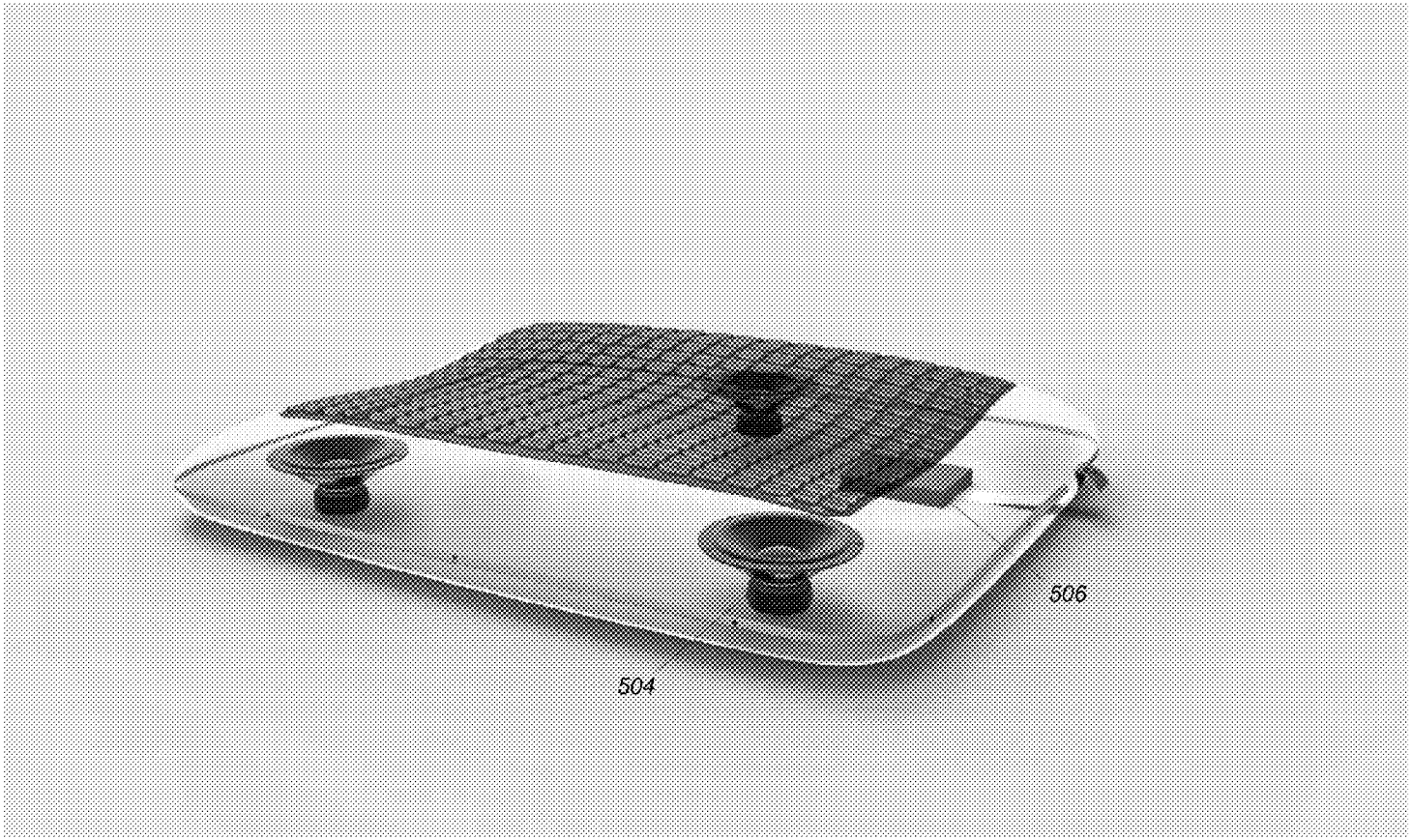
FIG. 6 is a pictorial diagram depicting a speaker arrangement within a pillow in accordance with embodiments of the present disclosure.

FIGS. 5 and 6 illustrate an embodiment of a noise cancellation system according to the present disclosure in the form of a noise cancellation pillow 500. As shown in FIG. 5, the pillow 500 may include a large microphone array 502 having many dozens of soft microphone elements canvassing much of the upper surface of the pillow 500. In some implementations, a user may have a (preferably sound-permeable) cover such as a pillowcase to place over the array 502, but as shown the user may place a head directly on the array 502 when using the pillow 500.

As shown in FIG. 6, a plurality of speakers 504 are located under the surface of the pillow 500 at locations spread around the edge. Although three speakers 504 are shown, it will be understood that more or fewer speakers may be used in accordance with different embodiments of the disclosure. The acoustic properties of the speakers, including the acoustic properties of any soft material associated with the pillow 500 that sits above and around the speakers 504, is known and is taken into account by the noise cancellation processing. As shown, the digital processing takes place in a controller 506 which is in electric communication with both the array 502 and each of the speakers 504. All of the electrical components may be, for example, battery-powered or powered by plugging in an electrical cord (not shown).

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the claims be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter, which is limited only by the claims which follow.

An "application" or "interface" is not software per se and includes at least some tangible, non-transitory hardware that is configured to execute computer readable instructions. In addition, the phrase "based on" does not imply exclusiveness—for example, if X is based on A, X can also be based on B, C, and/or D.

What is claimed is:

1. An automated method for noise cancelation, comprising:

receiving first signals from a first plurality of microphones positioned within a microphone array outside a target area;

identifying, from the received first signals, a first noise and a first position information for a first source for the first noise external to the target area;

determining a cancelation sound for the first noise based on the first noise and the first position information;

playing the first cancelation sound as the first noise reaches the target area so as to at least partly cancel the first noise within the target area;

receiving second signals from a second plurality of the microphones;

identifying, from the received second signals, a second noise and a second position information for a second source for the second noise within the target area;

determining a second cancelation sound for the second noise based on the second noise and the second position information; and playing the second cancelation sound to at least partly cancel the second noise.

2. The method of claim 1, wherein a beam forming algorithm is used to identify the first position information for the first source for the first noise.

3. The method of claim 2, wherein the beam forming algorithm is selected in order to minimize the time needed to identify the first position information such that the total processing time necessary before the first cancelation sound is determined, is played, and reaches the target area is less than the time it takes the first noise to reach the target area.

4. The method of claim 1, wherein determining the first cancelation sound further includes determining directional components of the first cancelation sound to play over speakers selected from a plurality of speakers disposed near the target area for noise cancelation.

5. The method of claim 1, wherein determining the first cancelation sound comprises using a least mean squares algorithm against a plurality of preselected spatial points within the target area in order to minimize the resulting sound at the preselected points.

6. The method of claim 1, wherein the second plurality of microphones is the plurality of the microphones.

7. The method of claim 1, wherein a beam forming algorithm is used to identify the second position information for the second source for the second noise.

8. The method of claim 1, wherein determining the second cancelation sound further includes determining directional components of the second cancelation sound to play over speakers selected from a plurality of speakers disposed near the target area for noise cancelation.

9. The method of claim 1, wherein determining the second cancelation sound comprises using a least mean squares algorithm against a plurality of preselected spatial points within the target area in order to minimize the resulting sound at the preselected points.

10. A system for noise cancelation, comprising:

an array of microphones positioned outside a target area to detect noises;

a controller configured to:

receive data from the microphone array, identify the detected noises based on the received data, wherein the detected noises comprise a first noise that is external to the target area and a second noise that is within the target area, use beam forming to identify details of the detected noises, wherein the details comprise a first position information for a first source for the first noise and a second position information for a second source for the second noise, and generate cancelation noises based on the detected noises and the details of the detected noises; and a plurality of speakers configured to play the cancelation noises received from the controller.

11. The system of claim 10, wherein the array, the controller, and the speakers are all disposed in a single portable device.

12. The system of claim 11, wherein the device is a pillow, and wherein the target area above the surface of the pillow where the pillow is shaped and configured to receive a head.

* * * * *